United States Patent [19]

Morris

[11] 4,052,965

[45] Oct. 11, 1977

[54] ENGINE COOLING SYSTEM VENT MEANS

[75] Inventor: Charles S. Morris, Pekin, Ill.

[73] Assignee: Caterpillar Tractor Co., Peoria, Ill.

[21] Appl. No.: 626,420

[22] Filed: Oct. 28, 1975

[51] Int. Cl.[2] ..... F16K 31/18; F01P 7/02

[52] U.S. Cl. ..... 123/41.05; 123/41.08; 123/41.54; 137/433; 165/40; 165/51; 236/34.5

[58] Field of Search ..... 123/41.54, 41.05, 41.08; 236/34.5; 165/40, 51; 137/202, 433, 533.11, 533.13

[56] References Cited

U.S. PATENT DOCUMENTS

| | | | |
|---|---|---|---|
| 1,897,492 | 2/1933 | Ledoux | 137/433 |
| 1,985,198 | 12/1934 | Williams | 123/41.54 X |
| 2,296,641 | 9/1942 | Hawkins, Jr. | 236/34.5 X |
| 3,726,262 | 4/1973 | Moon | 123/41.54 X |
| 3,786,829 | 1/1974 | Nardo et al. | 137/202 |
| 3,903,918 | 9/1975 | Carnarius | 137/433 |
| 3,921,600 | 11/1975 | Henning et al. | 123/41.54 |
| 3,939,901 | 2/1976 | Cieszko et al. | 123/41.54 X |

*Primary Examiner*—Carroll B. Dority, Jr.
*Assistant Examiner*—Sheldon Richter
*Attorney, Agent, or Firm*—Phillips, Moore, Weissenberger, Lempio & Majestic

[57] ABSTRACT

An engine cooling system vent valve is provided for allowing air to escape around a closed thermostat during filling and which closes to prevent circulation of coolant from bypassing the thermostat when the engine is cold and the thermostat is closed. The vent valve includes a ball within a housing having an inlet and an outlet and a support adapter having a plurality of grooves thereon for permitting passage of air.

6 Claims, 2 Drawing Figures

ENGINE COOLING SYSTEM VENT MEANS

BACKGROUND OF THE INVENTION

This invention is directed to an engine cooling system and particularly to a means for venting air during filling.

Currently, in engine cooling systems it is frequently the practice to provide an orifice between a first chamber of the thermostat housing which communicates with the engine and a second chamber of the thermostat housing which communicates with the engine. The purpose of providing this orifice is to allow entrained air in the cooling system fluid to vent when the thermostat is closed and the system is being filled. To a certain extent, the time required to fill the cooling system is dependent on the rate at which air escapes through the orifice, the radiator top tank and thence to atmosphere.

Use of a fixed orifice has not been entirely satisfactory since a small amount of coolant continues to circulate to the radiator even when the engine is cold by bypassing the closed thermostat. This unwanted circulation occurs, for example, during cold weather operation and causes the engine to continue to run cold, which is detrimental to engine operation.

To somewhat alleviate this problem, it has been the practice to provide movable shutters on vehicles having such a fixed orifice vent in order to prevent cold outside air from reaching the engine compartment. While the use of movable shutters is effective, they create an undesirably high level of noise when closed.

SUMMARY AND OBJECTS OF THE INVENTION

It is, therefore, the primary object of this invention to provide an improved vent means which permits more rapid filling of a cooling system and prevents circulation of coolant to the radiator during periods when the thermostat is closed.

It is also an object to provide a vent means which eliminates the need for radiator shutters and thus eliminates a source of noise.

The invention takes the form of a vent valve comprising a ball within a housing having an inlet and an outlet and a support adapter having a plurality of grooves thereon for permitting passage of air. The housing also includes a frustoconical valve seat for sealingly contacting the ball when the coolant flows through the housing, thereby closing off undesired circulation of coolant to the radiator when the engine is cold and the thermostat is closed.

Other objects and advantages will be more readily apparent from a review of the following description and drawings.

DETAILED DESCRIPTION

Figure 1:
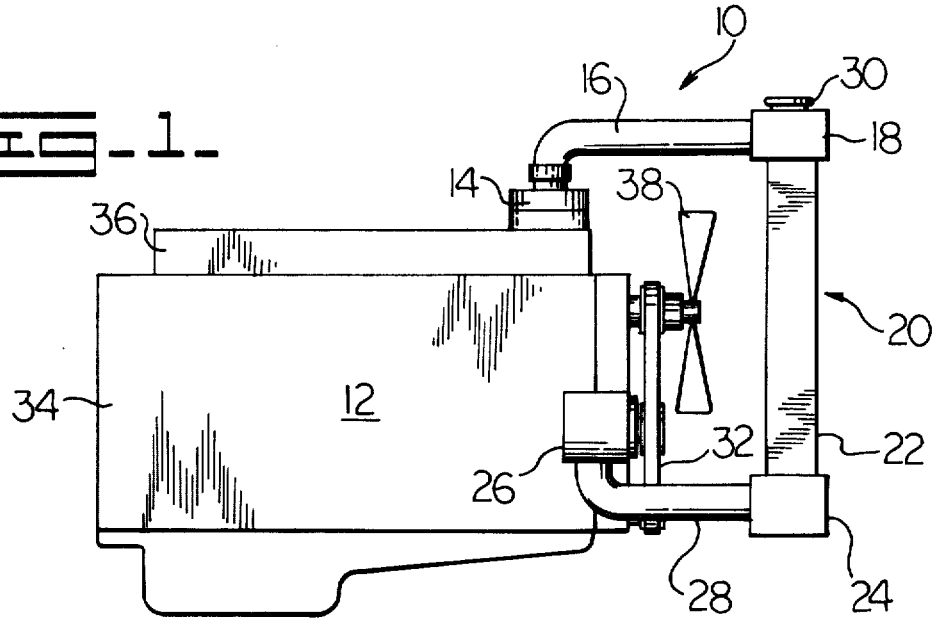
FIG. 1 is a side elevation view of an engine including a cooling system.

Referring to FIG. 1 there is shown generally at 10 an engine cooling system 10 for cooling an engine 12. The cooling system comprises a thermostat housing 14 communicating by way of a pipe or hose 16 with the top tank 18 of radiator 20 having radiator core 22. A bottom tank 24 of the radiator communicates with a pump 26 mounted on the engine by way of a pipe or hose 28.

The cooling system is filled through a cap aperture of filling neck 30 on top tank 18 and flows down through core 22 to bottom tank 24. Pump 26 driven off engine 12 by fan belt 32 pumps the coolant such as water into coolant passages (not shown) within the cylinder block 34 and cylinder head 36 of the engine where it absorbs heat generated by the engine. The coolant then flows up through thermostat assembly 14 to top tank 18 and thence down through radiator core 22 where it is cooled by air flow through the core assisted by fan 38.

Figure 2:
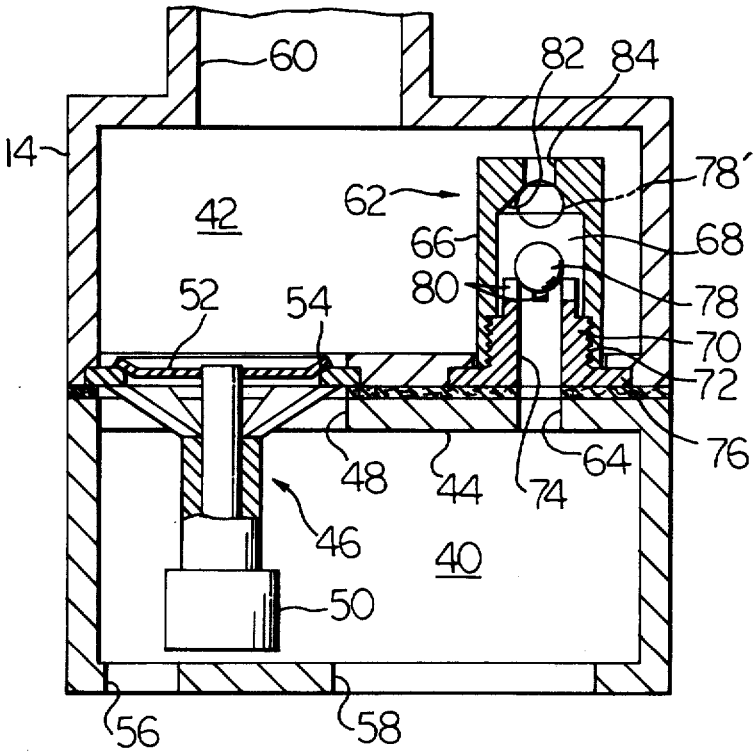
FIG. 2 is an enlarged cross-sectional view of a portion of the coolant system of the same, showing details of the vent valve of this invention.

Referring to FIG. 2, thermostat housing 14 comprises a body divided into first and second chambers 40, 42, respectively, by a wall 44. A thermostat assembly 46 is mounted in a first aperture 48 in wall 44. The thermostat assembly comprises a thermally sensitive element 50 which is thermally responsive to close valve element 52 against frustoconical seat 54 when the engine is cold and open it when the engine is warm, all in the conventional manner. When the engine is cold and valve element 52 closes off aperture 48, coolant is prevented from flowing from inlet ports 56, 58, through chambers 40 and 42 and outlet port 60.

A vent valve shown generally at 62 controls fluid flow through a second and smaller aperture 64 in wall 44. The vent valve is comprised of a generally cylindrical, hollow housing 66 having a chamber 68 therein. Housing 66 is secured to a generally cylindrical adapter 70 by means of mating threads 72. The adapter, in turn, is held in place wherein an axial bore 74 is in line with aperture 64 by means of circular flange 76 on the lower end thereof.

A sperical ball 78 is contained within the chamber 68. The clearance between the diameter of the ball 78 and the inside of housing 66 is such that a small flow of coolant medium will lift the ball. The ball is of a diameter larger than the diameter of bore 74 and normally sits astride adapter 70. A plurality of grooves 80 intersect at the top of the adapter and provide passage for air around the ball 78 when it is positioned thereon.

In operation when filling the cooling system, valve 62 permits air to pass from chamber 40 to chamber 42 by way of grooves 80 and around ball 78, which air would otherwise be restricted by the closing of thermostat assembly 46. When filling is complete and the engine is started and at idle, the coolant level will rise in chamber 40 and vent valve 62 until ball 78 is lifted up to position 78' where it seals against frustoconical seat 82 and closes off port 84. In this manner, circulation of cold coolant to the radiator will be prevented.

It is to be understood that other embodiments of the invention are possible and that, therefore, the invention is not to be limited, except by the scope of the following claims.

What is claimed is:

1. In an engine cooling system, a thermostat housing having first and second chambers, a coolant inlet in said second chamber, a coolant outlet in said first chamber, a first aperture intermediate said chambers, a thermostat means in said housing intermediate said chambers for controlling coolant flow from said inlet to said outlet through said first aperture, a second aperture in said housing intermediate said chambers, the improvement which comprises fluid flow responsive vent valve means in said housing for closing off said second aperture when the coolant level rises in said housing as when coolant is flowing in said system while allowing air to escape through said second aperture as during filling of the coolant system, wherein said vent valve means comprises a valve housing defining a chamber therein, a valve inlet and a valve outlet in said valve housing, a valve seat adjacent said valve outlet, and a means for closing said valve outlet, said means for closing said outlet comprising a spherical ball float adapted to float in the coolant and seal against said valve seat, said valve housing further comprising a generally cylindrical adapter having a bore therethrough of smaller diameter than the diameter of said spherical ball float, and groove means on one end of said adapter for permitting air to escape from said first chamber through said bore and said groove means to said second chamber.

2. The invention of claim 1 wherein said valve housing further includes a flange thereon for mounting within said thermostat housing.

3. The invention of claim 1 wherein said valve seat is frustoconical.

4. The invention of claim 1 wherein said groove means comprise a plurality of grooves on said one end of said adapter.

5. The invention of claim 1 including means removably mounting said valve housing on said adapter.

6. The invention of claim 5 wherein said means removably mounting said valve housing on said adapter comprise mating threads.

* * * * *